US005306395A

United States Patent [19]

Myrén

[11] Patent Number: 5,306,395

[45] Date of Patent: Apr. 26, 1994

[54] C-WRAP TYPE TWIN WIRE FORMER

[75] Inventor: H. Ingemar Myrén, Karlstad, Sweden

[73] Assignee: Valmet-Karlstad AB, Karlstad, Sweden

[21] Appl. No.: 42,880

[22] Filed: Apr. 5, 1993

[30] Foreign Application Priority Data

Apr. 23, 1992 [SE] Sweden ..... 9201283

[51] Int. Cl.[5] ..... D21F 1/00; D21F 5/18

[52] U.S. Cl. ..... 162/301; 162/111; 162/300; 162/306; 162/290

[58] Field of Search ..... 162/111, 116, 203, 206, 162/207, 290, 300, 301, 359.1

[56] References Cited

U.S. PATENT DOCUMENTS

| | | | |
|---|---|---|---|
| 3,301,746 | 1/1967 | Sanford et al. . | |
| 3,303,576 | 2/1967 | Sisson . | |
| 3,821,068 | 6/1974 | Shaw . | |
| 3,891,500 | 6/1975 | Kankaanpaa | 162/359.1 |
| 3,956,832 | 5/1976 | Justus . | |
| 4,036,684 | 7/1977 | Schmitt et al. | 162/301 |
| 4,102,737 | 7/1978 | Morton . | |
| 4,113,556 | 9/1978 | Kankaanpaa | 162/301 |
| 4,186,496 | 2/1980 | Beke et al. . | |
| 4,440,597 | 4/1984 | Wells et al. . | |
| 4,481,722 | 11/1984 | Guy et al. . | |
| 4,619,734 | 10/1986 | Andersson | 162/111 |

*Primary Examiner*—Karen M. Hastings
*Attorney, Agent, or Firm*—Bell, Seltzer, Park & Gibson

[57] ABSTRACT

In a known method of rebuilding a conventional tissue machine having a conventional C-wrap type twin wire forming section to a TAD machine, a TAD section, which includes a looped TAD fabric (24) and at least one TAD cylinder (22) located inside of the TAD fabric loop for thermally predrying the formed paper web (13) by passing hot air through the web, is incorporated in the machine. The rebuilding costs can be reduced, and reduced production costs for the web (13) as well as an increased quality of the produced web can be obtained by substituting a new outer forming fabric (35 or 43) for the existing one (3), said new outer fabric being longer than the existing one and having a comparatively plane web facing surface, so that on separating the two forming fabrics from each other the formed paper web (13) will adhere to and be carried by the web facing surface of the new outer forming fabric (35 or 43), and by providing means (36,37) for guiding the new outer forming fabric (35 or 43) with its web facing surface into contacting relationship with the TAD fabric (24) upstream of or on the TAD cylinder (22). A new C-wrap type twin wire former, which gives a drier web and is suitable for use in a TAD machine for the manufacture of high basis weight sanitary paper, is disclosed.

2 Claims, 3 Drawing Sheets

C-WRAP TYPE TWIN WIRE FORMER

TECHNICAL FIELD

The present invention relates to a method of rebuilding a papermaking machine, which has a conventional C-wrap type twin wire forming section, for the manufacture of a sanitary paper web, said method including incorporating in said machine a TAD section for thermally predrying the formed paper web by passing hot air through the web, said C-wrap type twin wire forming section having an endless looped inner forming fabric, a forming roll that is rotatable in a direction and is located inside of the inner forming fabric loop and has a portion wrapped by a portion of the inner forming fabric, an endless looped outer forming fabric partially wrapping said portion of the inner forming fabric, means for guiding the forming fabrics so as to form between then a converging forming throat located at a lower rising quadrant of the rotatable forming roll and curving along an upstream part of said wrapped portion of the forming roll, and a headbox for discharging a jet of papermaking furnish obliquely upwards into the forming throat, said furnish on drainage through at least the outer forming fabric being formed into a paper web sandwiched between the two forming fabrics, and said TAD section including an endless looped TAD fabric and at least one hollow TAD cylinder that is rotatable in the same direction as the forming roll and has a foraminous shell for the passage of hot air therethrough from the exterior to the interior of said at least one TAD cylinder in order to thermally predry the web, said at least one TAD cylinder being located inside of the TAD fabric loop and having a top portion that is wrapped by a portion of the TAD fabric.

The term "sanitary paper" as used herein is a generic term intended to include all kinds of creped or uncreped paper used for sanitary purposes, such as bathroom tissue, including toilet tissue and facial tissue, paper handkerchiefs, paper towels, kitchen or household paper, and industrial tissue or towel paper, for example. Occasionally, the term "tissue" is used for the same purpose.

Similarly, the term "TAD" as used herein is intended to mean "through air drying" or "through air dried" depending on the context in which the term is used.

The present invention also relates to a C-wrap type twin wire former of the kind having an endless looped inner forming fabric, a rotatable forming roll that is located inside of the inner forming fabric loop and has a portion wrapped by a portion of the inner forming fabric, an endless looped outer forming fabric partially wrapping said portion of the inner forming fabric, means for guiding the forming fabrics so as to form between them a converging forming throat located at a lower rising quadrant of the rotatable forming roll and curving along an upstream part of said wrapped portion of the forming roll, and a headbox for discharging a jet of papermaking furnish obliquely upwards into the forming throat, said furnish on drainage through at least the outer forming fabric being formed into a paper web sandwiched between the two forming fabrics.

BACKGROUND OF THE INVENTION

In conventional C-wrap type tissue formers the outer forming fabric is separated from the web and the inner forming fabric at a position on the forming roll or slightly downstream thereof. Carried by the inner forming fabric the web runs to a pick-up location, where a looped felt or other fabric is brought into contacting relationship with the web, and the web is transferred to the felt. Downstream of the pick-up location the felt with the web is trained around a press roll, which lightly presses the web against a yankee dryer and transfers the web to the yankee dryer. After drying on the yankee dryer the web is creped off and run to a web reeling apparatus.

It is generally accepted that through air drying of tissue as disclosed in U.S. Pat. Nos. 3,301,746 (Sanford et al.), 3,303,576 (Sisson), 3,821,068 (Shaw), 4,102,737 (Morton), 4,440,597 (Wells et al.), and 4,481,722 (Guy et al.), for example, greatly enhances product softness, bulk and absorbency. While much effort is spent creating and restoring these characteristics to the conventionally manufactured products, softness and absorbency are inherent in the through air process. What has been less appreciated is the underlying economics behind the through air dried soft tissue manufacturing process. However, bearing in mind that the basis for consumer usage is the area of the tissue product and not the weight, and that to a customer a single-ply TAD product is at least equivalent to a conventionally produced two-ply product, a comparison can be summarized as follows:

1. The ability to manufacture a product using less raw material (reduced basis weight) with the TAD process results in significant cost savings over a market equivalent sheet manufactured on a conventional machine.

2. Energy costs, when examined on the basis of area of saleable product, are actually less for the products made on a TAD machine.

3. The combined effect of less cost per unit area of product produced and increased production rates, makes the economics of through air dried products very favorable in comparison to conventionally manufactured products.

The above advantages of the TAD technology have resulted in an increasing interest of tissue mills in rebuilding conventional tissue machines to TAD machines, substantially as outlined above, which has required the incorporation of a transfer section having a transfer fabric for picking up the web from the inner forming fabric and transferring the web to the TAD fabric that replaces the felt. The incorporation of a transfer section increases the rebuilding costs as well as the total number of sheet transfers, which increases fiber losses and reduces overall efficiency.

SUMMARY OF THE INVENTION

According to one aspect of the present invention, one object of the invention is to provide a rebuilding method, which reduces the rebuilding costs and results in reduced production costs for the web as well as an increased quality of the produced web.

In a method of the kind described in the first paragraph above, this object is achieved in accordance with the present invention by substituting a new outer forming fabric loop for the existing outer forming fabric loop, said new outer fabric loop being of greater length than that of the existing one and having a comparatively plane web facing surface, so that on separating the two forming fabrics from each other the formed paper web will adhere to and be carried by said comparatively plane web facing surface of the new outer forming fabric, said length being sufficient for permitting the new outer forming fabric loop to extend to the TAD fabric, and providing means for guiding the new outer forming fabric with its web facing surface into contacting relationship with the TAD fabric upstream of or on the TAD cylinder.

As no separate transfer section is being used, the costs for the rebuilding of the machine are reduced. Further, the number of web transfer locations is reduced, which minimizes web compaction, fiber losses are minimized, the sheet structure obtained at the forming of the web is maintained, and the produced web will get an improved "tensile efficiency". Tensile efficiency is defined as the ratio of the tensile strength of a machine formed web over that of a hand formed sheet of the same basis weight.

In order to facilitate a transfer of the web from the new outer forming fabric to the TAD fabric, a transfer suction member, e.g., a transfer suction box, may be provided inside of the TAD fabric loop at a location where the new outer forming fabric is in contacting relationship with the TAD fabric. The transfer suction box suitably is located either immediately upstream of the TAD cylinder or inside said at least one TAD cylinder in contacting relationship with the foraminous shell of the TAD cylinder.

It is preferred to provide a suction box inside of the new outer forming fabric loop and in contacting relationship therewith at a location immediately upstream of where the new outer forming fabric contacts the TAD fabric, said suction box being adapted to raise a dry solids content of the web by sucking water out of the web prior to such contact. A further increase of the dry solids content of the web may be obtained by substituting a suction forming roll for the existing forming roll.

For raising the dry solids content of the web still more prior to the arrival of the web to the TAD fabric it is also preferred to provide means for first separating the new outer forming fabric from the formed web and the inner forming fabric, so that the web will be carried by the inner forming fabric, provide means for then running the new outer forming fabric for a certain distance spaced from the inner forming fabric and the web carried thereby, provide means for thereafter guiding the new outer forming fabric into a renewed contacting relationship with the inner forming fabric and the web carried thereby, so that the web once more will be sandwiched between the two forming fabrics prior to a final separation of the new outer forming fabric and the web from the inner forming fabric, provide means for ensuring at said final separation a transfer of the once more sandwiched web from the inner forming fabric to the new outer forming fabric, and provide at least one suction box inside of the inner forming fabric loop and in contacting relationship therewith at a location where the new outer forming fabric is temporarily separated from the web and the inner forming fabric, said at least one suction box being adapted to raise a dry solids content of the web by sucking water out of the web.

To facilitate the sucking of water out of the web by said at least one suction box, it is preferred to provide at least one steam box on the web carrying side of the inner forming fabric in a location opposite that of said at least one suction box, said at least one steam box being adapted to discharge steam onto the web. The heating of the wet web by direct steam has no deleterious effect on the fibers but heats the water to reduce its viscosity, thereby facilitating the sucking of the water out of the web.

The machine to be rebuilt usually has a yankee dryer that is rotatable in the same direction as the forming roll, and a press section interconnecting the forming section and the yankee dryer. The press section includes an endless looped transfer fabric, first means for guiding the transfer fabric into contacting relationship with the inner forming fabric and the web carried thereby, means for transferring the web from the inner forming fabric to the transfer fabric, and second means for guiding the transfer fabric and the web carried thereby into contacting relationship with the yankee dryer. The second transfer fabric guiding means usually include a press roll located at a lower rising quadrant of the rotatable yankee dryer for lightly pressing the transfer fabric and the web carried thereby against the yankee dryer to transfer the web to the yankee dryer. To permit maintained direction of rotation of the yankee dryer, the method according to the invention preferably further comprises providing a guide member inside of the transfer fabric loop for guiding the transfer fabric into contacting relationship with the TAD fabric and the web carried thereby downstream of said at least one TAD cylinder, providing means for transferring the web from the TAD fabric to the transfer fabric, and, if desired, substituting a new transfer fabric for the existing one.

According to another aspect of the present invention, another object of the invention is to provide an improved C-wrap type twin wire former, in which a high basis weight sanitary paper web of enhanced dry solids content may be produced, what makes it extraordinarily suitable for use in a TAD machine for the manufacture of high basis weight sanitary paper.

In accordance with the present invention, this other object is achieved by providing the C-wrap twin wire former of the kind described in the fourth paragraph above with means for first separating the outer forming fabric from the formed web and the inner forming fabric, so that the web will be carried by the inner forming fabric; means for then running the outer forming fabric for a certain distance spaced from the inner forming fabric and the web carried thereby; means for thereafter guiding the outer forming fabric into a renewed contacting relationship with the inner forming fabric and the web carried thereby, so that the web once more will be sandwiched between the two forming fabrics prior to a final separation of the outer forming fabric and the web from the inner forming fabric; means for ensuring at said final separation a transfer of the once more sandwiched web from the inner forming fabric to the outer forming fabric; and at least one suction box provided inside of the inner forming fabric loop and in contacting relationship therewith at a location where the outer forming fabric is temporarily separated from the web and the inner forming fabric, said at least one suction box being adapted to raise a dry solids content of the web by sucking water out of the web.

To facilitate the sucking of water out of the web by said at least one suction box, it is preferred to provide at least one steam box on the web carrying side of the inner forming fabric in a location opposite that of said at least one suction box, said at least one steam box being adapted to discharge steam onto the web. The heating of the moist web by direct steam has no deleterious effect on the fibers but heats the water to reduce its viscosity, thereby facilitating the sucking of the water out of the web.

Additional features that characterize the invention and what is achieved by means of these features will be described below.

DETAILED DESCRIPTION OF THE PREFERRED EMBODIMENTS

Figure 1:
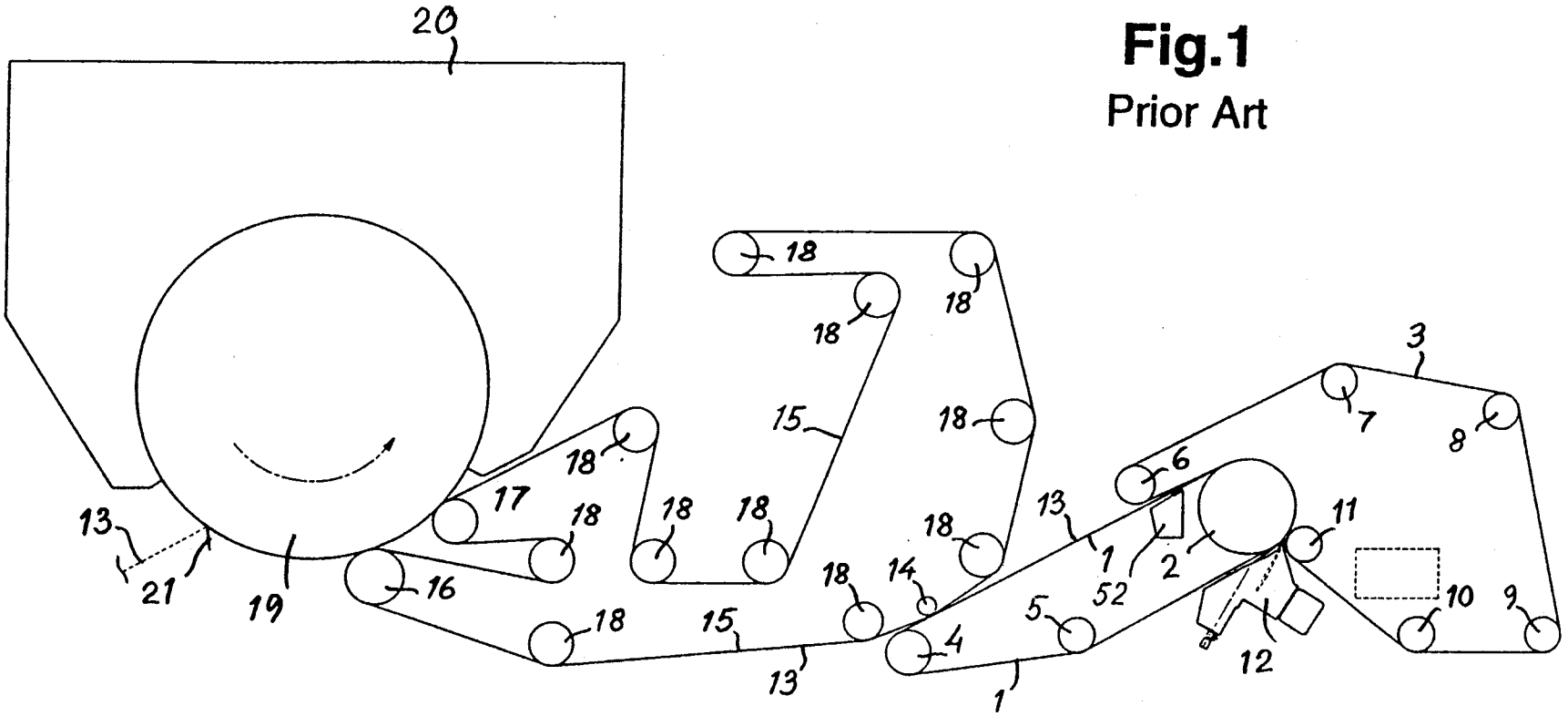
Fig.1 Prior Art
FIG. 1 is a slightly simplified side elevational view of a conventional C-wrap type twin wire former tissue machine.

FIG. 1 illustrates a conventional tissue machine that may be said to include a forming section, a press section and a drying section. The shown forming section includes a conventional C-wrap type twin wire former having an endless looped inner forming fabric 1, a forming roll 2 that is rotatable in one direction and is located inside of the inner forming fabric loop and has a portion wrapped by the inner forming fabric 1, and an endless looped outer forming fabric 3 partially wrapping said portion of the inner forming fabric 1. Means, such as rolls 4 and S located inside of the inner forming fabric loop 1, and rolls 6 to 11 located inside of the outer forming fabric loop 3, are provided for guiding the two forming fabrics so as to form between them a converging forming throat located at a lower raising quadrant of the rotatable forming roll 2. Roll 11 may be termed a breast roll. A headbox 12, which may be a multilayer headbox, if desired, is provided for discharging a jet of papermaking furnish obliquely upwards into the forming throat. On being squeezed between the two forming fabrics 1 and 3 on the forming roll 2, the furnish is partially dewatered at least through the outer forming fabric 3 to form a consolidated but wet web 13 sandwiched between the fabrics. As illustrated, the outer forming fabric 3 is separated from the formed web 13 and the inner forming fabric 1 at a position on the forming roll 2 or on a transfer suction box 52 slightly downstream thereof.

Carried by the inner forming fabric I the web 13 runs to a pick-up location, where by means of a pick-up member, such as a roll 14 or a suction box (not shown), an endless looped felt 15 or other fabric is brought into contacting relationship with the web 13, and the web 13 is transferred to the felt 15. Pick-up roll 14 and felt 15 are included in the press section as are one or two press rolls 16 and 17 located inside of the felt loop, and a plurality of guide rolls, all of which are designated 18, located inside as well as outside of the felt loop. The first press roll 16 forms a first press nip with a yankee dryer 19, which is rotatable in the same direction as the forming roll 2, and transfers the web 13 to the yankee dryer 19, while the second press roll 17 forms a second press nip with the yankee dryer 19 for exposing the web 13 to a second pressing action.

On the yankee dryer 19, which is included in the drying section and is provided with a hot air hood 20 for directing a flow of hot air against the web 13 while the web is adhered to the yankee dryer 19 so as to assist in the drying of the web, the web 13 is dried to final dryness. The web is creped off from the yankee dryer 19 by means of a creping doctor 21 and then run to a web reeling apparatus, not shown.

Other conventional equipment, e.g., means for keeping the fabrics and the felt clean, and means for applying an adhesive onto the cylinder surface of the yankee dryer to make the web adhere controllably thereto, is not shown.

Figure 2:
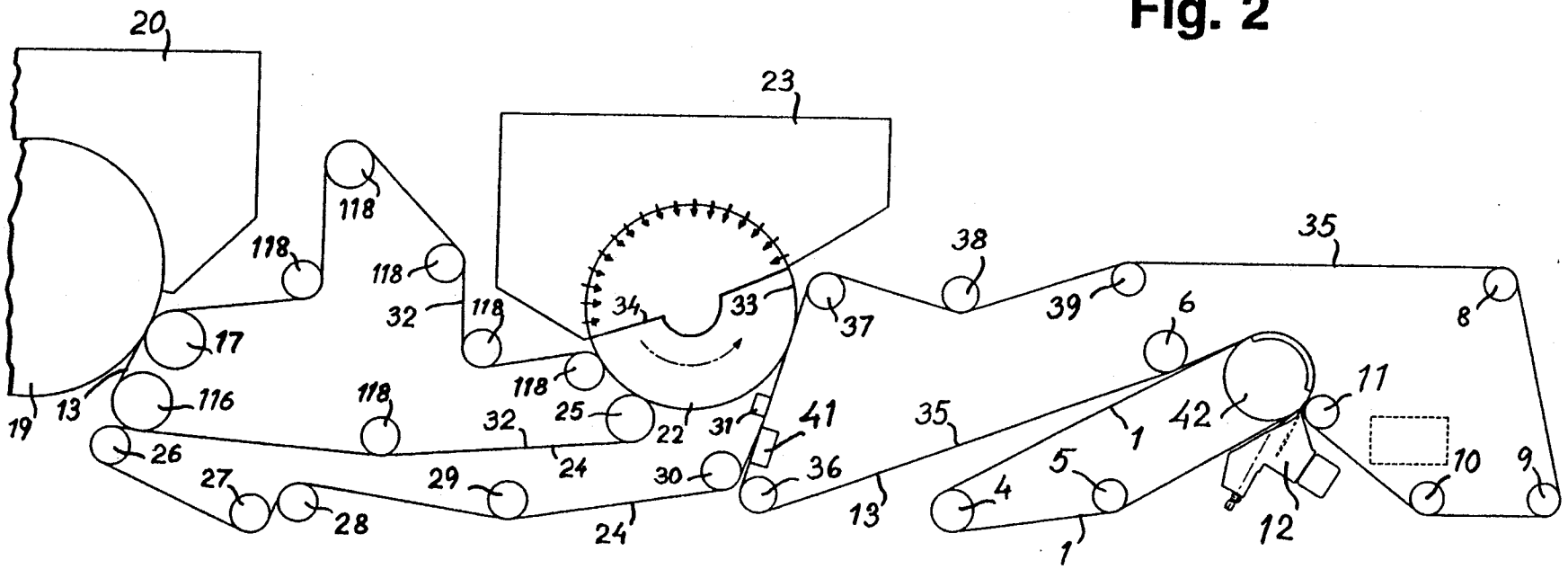
FIG. 2 is a slightly simplified side elevational view of the machine shown in FIG. 1 after the rebuilding thereof in accordance with the present invention to a first preferred embodiment of a TAD machine.

FIG. 2 shows the machine of FIG. 1 after it has been rebuilt to a TAD machine in accordance with a first embodiment of the present invention. In the TAD machine a TAD section for thermally predrying the web by passing hot air through the web is substituted for the press section of the conventional machine. The TAD section includes at least one TAD cylinder 22, a TAD hood 23, an endless looped TAD fabric 24, a plurality of guide rolls designated 25, 26; 27, 28, 29, and 30 for the TAD fabric 24, a transfer suction member, e.g., a transfer suction box 31, for transferring the web 13 from the forming section to the TAD fabric 24, an endless looped transfer fabric 32, and a press roll 17, a guide roll 116 preceding the press roll 17, and a plurality of other guide rolls lie for the transfer fabric 32. The guide rolls 118 are identical with the felt guide rolls 18 in FIG. 1, but since they are rearranged in new positions they are designated 118. The second press roll 17 from FIG. 1 is used as a single press roll for lightly pressing the transfer fabric 32 and the web 13 carried thereby against the cylinder surface of the yankee dryer 19, and the guide roll 25 for the TAD fabric 24 is used as a guide roll also for the transfer fabric 32.

The TAD cylinder 22 is located inside of the TAD fabric loop 24 and has a top portion that is wrapped by a portion of the TAD fabric 24. Further, the TAD cylinder 22 is rotatable in the same direction as the forming roll 2 and the yankee dryer 19, and it is hollow and has a foraminous shell 33 for the passage of hot air therethrough from the exterior to the interior of the TAD cylinder 22 in order to thermally predry the web 13. The hot air is supplied from the TAD hood 23, which is located on top of the wrapped top portion of the TAD cylinder 22, and the hot air passes from the hood 23 through the web 13, the TAD fabric 24, and the foraminous shell 33 to the interior of the TAD cylinder 22 during absorption of moisture from the web 13. Guide walls 34 are provided inside of the foraminous shell 33 for conducting the moist air out through an end wall of the TAD cylinder 22. Means, not shown, are provided for recirculating at least part of this air to the TAD hood 23 and for achieving a desired temperature and dryness of the hot air fed to the hood 23.

The TAD fabric 24 carrying the predried web 13 runs off from the TAD cylinder 22 at or slightly upstream of the guide roll 25. Simultaneously therewith or slightly prior thereto the predried web 13 will be sandwiched between the TAD fabric 24 and the transfer fabric 32 and run sandwiched between these fabrics up to the guide roll 116 immediately preceding press roll 17. Said guide roll 116 operates as a transfer roll for transferring the web 13 from the TAD fabric 24 to the transfer fabric 32. To ensure that the web 13 will be picked up by the transfer fabric 32, the suction press roll 16 of FIG. 1 may be used as the guide roll in this position.

In accordance with the present invention the method of rebuilding the conventional machine shown in FIG. 1 into a TAD machine, such as the one illustrated in FIG. 2, comprises substituting a new outer forming fabric loop 35 for the existing outer forming fabric loop 3. The new outer fabric loop 35 is of greater length than that of the existing one and has a comparatively plane web facing surface, so that on separation of the two forming fabrics 1 and 35 from each other, the formed paper web 13 will adhere to and be carried by said comparatively plane web facing surface of the new outer forming fabric 35. The new outer forming fabric 35 is of such length that it will extend to the TAD fabric 24. Further, the method comprises providing means for guiding the new outer forming fabric 35 with its web facing surface into contacting relationship with the TAD fabric 24 upstream of or on the TAD cylinder 22. These guiding means include a plurality of guide rolls designated 36, 37, 38, and 39, which are substituted for guide roll 7 in FIG. 1. The positions of guide rolls 36 and 37 are such that between these two guide rolls the new forming fabric 35 will run in a substantially straight line forming a tangent to the TAD cylinder 22.

By extending the new outer forming fabric 35 to the TAD section and ensuring that the formed web 13 follows the outer forming fabric instead of the inner forming fabric, no separate transfer section for the transfer of the web from the forming section to the TAD section is necessary, and the costs for rebuilding the machine are reduced. Further, the number of web transfer locations is reduced, which minimizes web compaction, fiber losses are minimized, the sheet structure obtained at the forming of the web is maintained, and the produced web will get an improved tensile efficiency.

Figure 3:
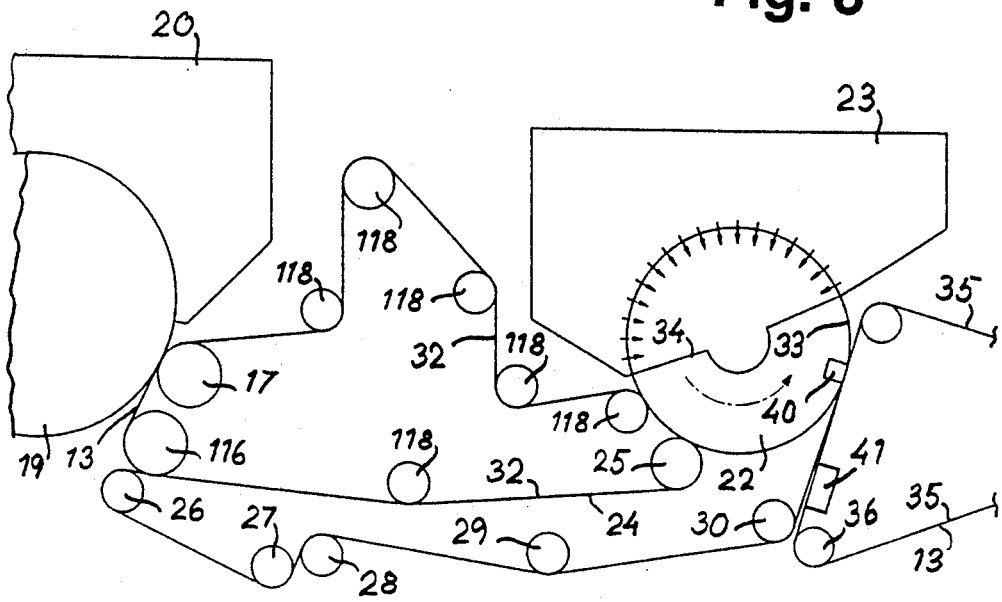
FIG. 3 is an enlarged scale detail similar to a portion of FIG. 2 and shows an alternative embodiment, in which a transfer suction box is located in the TAD cylinder.

In order to facilitate a transfer of the web 13 from the new outer forming fabric 35 to the TAD fabric 24, a transfer suction member, e.g., a transfer suction box, may be provided inside of the TAD fabric loop at a location where the new outer forming fabric 35 is in contacting relationship with the TAD fabric 24. In the embodiment shown in FIG. 2 the transfer suction box 31 is located immediately up-stream of the TAD cylinder 22. However, as illustrated in FIG. 3, the transfer suction box, here designated 40, may also be located inside the TAD cylinder 22 in contacting relationship with the foraminous shell 33 of the TAD cylinder 22 at the place where the new outer forming wire 35 makes contact with the TAD fabric portion that wraps the shell 33.

It is preferred to provide a suction box 41 inside of the new outer forming fabric loop 35 and in contacting relationship therewith at a location immediately upstream of where the new outer forming fabric 35 contacts the TAD fabric 24. The suction box 41 is adapted to raise a dry solids content of the wet web 13 by sucking water out of the web 13 prior to such contact.

Figure 4:
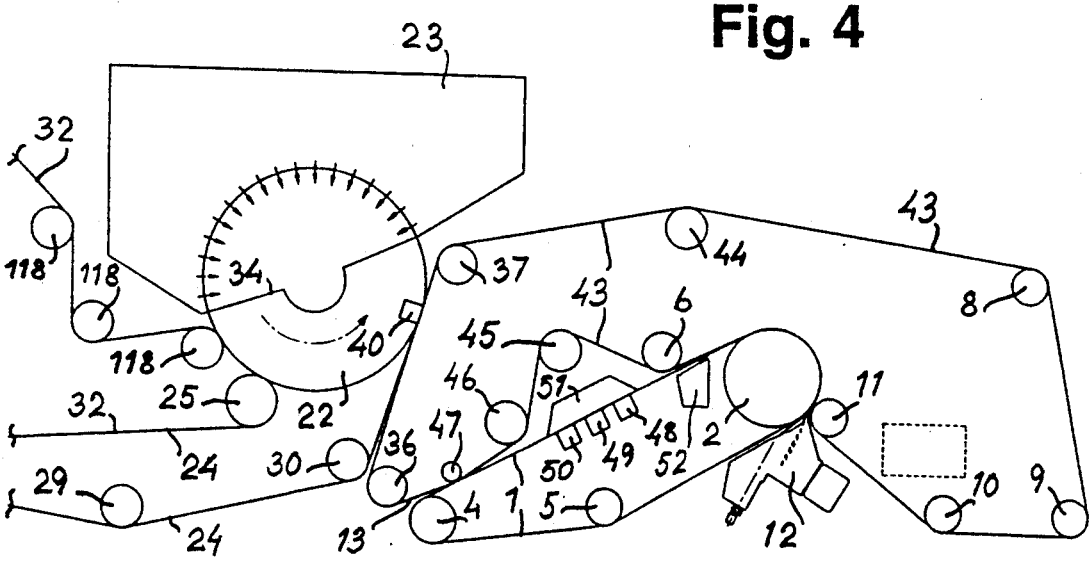
FIG. 4 is a simplified side elevational view of an alternative embodiment of the C-wrap type twin wire former after the rebuilding thereof in accordance with the present invention.

FIG. 4 illustrates another preferred embodiment of the C-wrap type twin wire former after the rebuilding thereof in accordance with the present invention. This other embodiment is particularly suitable for the production of a high basis weight sanitary paper web of enhanced dry solids content, what makes it particularly suitable for use in a TAD machine for the manufacture of high basis weight sanitary paper. As in FIGS. 2 and 3, a new outer forming fabric loop 43 is substituted for the existing outer forming fabric loop 3, and the new outer fabric loop 43 is of greater length than that of the existing one. Preferably, it is of the same type as the outer forming fabric 3 used in FIG. 1. The new outer forming fabric 43 also is of such length that it will extend to the TAD fabric 24. Like in FIG. 2, means are also provided for guiding the new outer forming fabric 43 with its web facing surface into contacting relationship with the TAD fabric 24 upstream of or on the TAD cylinder 22. These guiding means include a plurality of guide rolls designated 36, 37, and 44, guide roll 44 being substituted for guide rolls 38 and 39 in FIG. 2. The positions of the guide rolls 36 and 37 are moved horizontally in a direction towards the forming roll, but they are still such that between these two guide rolls the new forming fabric 43 will run in a substantially straight line forming a tangent to the TAD cylinder 22 as wrapped by the TAD fabric 24. Further, the transfer suction box for transferring the web 13 from the outer forming fabric to the TAD fabric 24 is shown as being located at position 40 inside the TAD cylinder 22 like in FIG. 3, but it might as well be located at position 31 immediately upstream of the TAD cylinder 22 like in FIG. 2. The forming roll may be a plain surfaced forming roll 2 like in FIG. 1 or, if desired, it may alternatively be a suction type forming roll 42 like in FIG. 2. The positions of the forming throat and the headbox 12 remain unchanged.

The primary difference between the two embodiments is that in the one illustrated in FIG. 4 there are provided:

(a) Means for first separating the outer forming fabric 43 from the formed web 13 and the inner forming fabric 1, so that the web 13 will be carried by the inner forming fabric 1. In the embodiment shown in FIG. 4 these means include the guide roll 6 for separating the outer forming fabric 43 from the inner forming fabric 1. If desired, the separating means may also include a transfer suction box 52 located inside of the inner forming fabric loop I immediately downstream of the forming roll.

(b) Means for then running the outer forming fabric 43 for a certain distance spaced from the inner forming fabric 1 and the web 13 carried thereby. In the embodiment shown in FIG. 4 these means include a first guide roll 45 spaced at least one roll diameter from the inner forming fabric I and located as a first roll downstream of the guide roll 6 and outside of the outer forming fabric loop 43, and a subsequent second guide roll 46 spaced less than one roll diameter from the inner forming fabric 1 and located inside of the outer forming fabric loop 43.

(c) Means for thereafter guiding the outer forming fabric 43 into a renewed contacting relationship with the inner forming fabric 1 and the web 13 carried thereby, so that the web 13 once more will be sandwiched between the two forming fabrics 1 and 43 prior to a final separation of the outer forming fabric 43 and the web 13 from the inner forming fabric 1. In the embodiment shown in FIG. 4 this means includes a roll 47 or, alternatively, a suction transfer box (not shown).

(d) Means for ensuring at said final separation a transfer of the once more sandwiched web 13 from the inner forming fabric I to the outer forming fabric 43. In the embodiment shown in FIG. 4 the roll 47 is a pick-up roll, and the transfer ensuring means includes the plain surface of roll 47.

(e) At least one suction box provided inside of the inner forming fabric loop I and in contacting relationship therewith at a location where the outer forming fabric 43 is temporarily separated from the web 13 and the inner forming fabric 1, said at least one suction box being adapted to raise a dry solids content of the web 13 by sucking water out of the web 13. In the embodiment shown in FIG. 4 there are three suction boxes 48, 49, and So provided at said location.

To facilitate the sucking of water out of the web 13 by said at least one suction box or the suction boxes 48, 49, and 50 shown in FIG. 4, it is preferred to provide at least one steam box 51 on the web carrying side of the inner forming fabric 1 in a location opposite that of said at least one suction box or the suction boxes 48, 49, and 50, said at least one steam box 51 being adapted to discharge steam onto the web 13. The heating of the moist web 13 by direct steam has no deleterious effect on the fibers but heats the water to reduce its viscosity, thereby facilitating the sucking of the water out of the web 13.

While the present invention above has been described with reference to the drawings, which show a few preferred embodiments, several obvious modifications thereof are possible within the scope of the appended claims. As an illustrative example it would be obvious to modify the shown embodiments by installing one or more TAD cylinders in addition to said at least one TAD cylinder 22, cf. U.S. Pat. Nos. 3,303,576 (Sisson), 3,956,832 (Justus), and 4,186,496 (Beke et al.), for example. Of course, this would also require a longer TAD fabric and the installation of more guide rolls for the TAD fabric.

What is claimed is:

1. An improved C-wrap twin wire former having an endless looped inner forming fabric, a rotatable forming roll that is located inside of the inner forming fabric loop and has a portion wrapped by a portion of the inner forming fabric, an endless looped outer forming fabric partially wrapping said portion of the inner forming fabric, means for guiding the forming fabrics so as to form between them a converging forming throat located at a lower rising quadrant of the rotatable forming roll and curving along an upstream part of said wrapped portion of the forming roll, and a headbox for discharging a jet of papermaking furnish obliquely upwards into the forming throat, said furnish on drainage through at least the outer forming fabric being formed into a paper web sandwiched between the two forming fabrics, wherein the improvement comprises:

means for first separating the outer forming fabric from the formed web and the inner forming fabric, so that the web will be carried by the inner forming fabric;

means for then running the outer forming fabric for a certain distance spaced from the inner forming fabric and the web carried thereby;

means for thereafter guiding the outer forming fabric into a renewed contacting relationship with the inner forming fabric and the web carried thereby, so that the web once more will be sandwiched between the two forming fabrics prior to a final separation of the outer forming fabric and the web from the inner forming fabric;

means for ensuring at said final separation a transfer of the once more sandwiched web from the inner forming fabric to the outer forming fabric; and at least one suction box provided inside of the inner forming fabric loop and in contacting relationship therewith at a location where the outer forming fabric is temporarily separated from the web and the inner forming fabric, said at least one suction box being adapted to raise a dry solids content of the web by sucking water out of the web.

2. An improved C-wrap twin wire former as claimed in claim 1, further comprising at least one steam box on the web carrying side of the inner forming fabric in a location opposite that of said at least one suction box, said at least one steam box being adapted to discharge steam onto the web to facilitate the sucking of water out of the web by said at least one suction box.

* * * * *